US009640352B2

(12) United States Patent
Daum et al.

(10) Patent No.: US 9,640,352 B2
(45) Date of Patent: May 2, 2017

(54) OVERVOLTAGE PROTECTION DEVICE HAVING A THERMAL DISCONNECTION APPARATUS

(71) Applicant: DEHN + SÖHNE GMBH + CO.KG, Neumarkt (DE)

(72) Inventors: Richard Daum, Neumarkt (DE); Sascha Ludewig, Neumarkt (DE)

(73) Assignee: DEHN + SÖHNE GmbH + Co.KG, Neumarkt (DE)

( * ) Notice: Subject to any disclaimer, the term of this patent is extended or adjusted under 35 U.S.C. 154(b) by 0 days.

(21) Appl. No.: 14/766,613

(22) PCT Filed: Jan. 30, 2014

(86) PCT No.: PCT/EP2014/051751

§ 371 (c)(1),
(2) Date: Aug. 7, 2015

(87) PCT Pub. No.: WO2014/122056

PCT Pub. Date: Aug. 14, 2014

(65) Prior Publication Data

US 2016/0035523 A1 Feb. 4, 2016

(30) Foreign Application Priority Data

Feb. 8, 2013 (DE) ..... 10 2013 002 302
Apr. 8, 2013 (DE) ..... 10 2013 006 052

(51) Int. Cl.
*H01H 37/08* (2006.01)
*H01H 37/76* (2006.01)
(Continued)

(52) U.S. Cl.
CPC ..... *H01H 37/761* (2013.01); *H01C 7/126* (2013.01); *H01H 37/08* (2013.01); *H01T 1/12* (2013.01);
(Continued)

(58) Field of Classification Search
CPC .. H01C 7/126; H01T 1/14; H01T 1/12; H01H 37/761; H01H 37/08; H01H 2235/01; H01H 2037/762; H01H 2207/022
(Continued)

(56) References Cited

U.S. PATENT DOCUMENTS 3,761,856 A 9/1973 Mantelet
6,922,131 B2 * 7/2005 Walsh ..... H01C 1/016 337/159
(Continued)

FOREIGN PATENT DOCUMENTS

DE 1 515 019 6/1969
DE 2 220 264 11/1972
(Continued)

OTHER PUBLICATIONS

International Search Report and Written Opinion for International Application No. PCT/EP2014/051751, dated Apr. 23, 2014, 10 pages. [no English translation available].

*Primary Examiner* — Anatoly Vortman
(74) *Attorney, Agent, or Firm* — Christopher R. Christenson; Kelly, Holt & Christenson, PLLC

(57) ABSTRACT

An overvoltage protection device comprises at least one overvoltage protection unit having at least one contact lug as well as a mechanical disconnection apparatus that is activated in the event of a thermal overload. The mechanical disconnection apparatus comprises a connection element that can be moved from a closed position to a current-interrupting or voltage-disconnecting position by a slider that is preloaded by spring force.

10 Claims, 8 Drawing Sheets

(51) Int. Cl.
*H01C 7/12* (2006.01)
*H01T 1/14* (2006.01)
*H01T 1/12* (2006.01)

(52) U.S. Cl.
CPC ..... *H01T 1/14* (2013.01); *H01H 2037/762* (2013.01); *H01H 2207/022* (2013.01); *H01H 2235/01* (2013.01)

(58) Field of Classification Search
USPC ..... 337/408
See application file for complete search history.

(56) References Cited

U.S. PATENT DOCUMENTS

| | | | | |
|---|---|---|---|---|
| 7,477,503 | B2 * | 1/2009 | Aszmus | H01C 7/126 361/103 |
| 7,684,166 | B2 * | 3/2010 | Donati | H01C 7/126 361/103 |
| 7,839,257 | B2 * | 11/2010 | Cernicka | H01C 7/126 337/142 |
| 8,526,159 | B2 * | 9/2013 | Ludewig | H01C 7/126 361/111 |
| 8,836,464 | B2 * | 9/2014 | Wang | H01C 7/126 337/401 |
| 2011/0222199 | A1 * | 9/2011 | Ludewig | H01C 7/126 361/91.1 |

FOREIGN PATENT DOCUMENTS

| | | | |
|---|---|---|---|
| DE | 295 19 313 | 1/1996 | |
| DE | 102007006617 B3 * | 9/2008 | H01C 7/12 |
| DE | 10 2007 042 991 | 12/2008 | |
| EP | 0 905 839 | 3/1999 | |
| EP | 0 987 803 | 3/2000 | |

* cited by examiner

OVERVOLTAGE PROTECTION DEVICE HAVING A THERMAL DISCONNECTION APPARATUS

CROSS-REFERENCE TO RELATED APPLICATION

This Application is a Section 371 National Stage Application of International Application No. PCT/EP2014/051751, filed Jan. 30, 2014 and published as WO 2014/122056 A1 on Aug. 14, 2014, the contents of which are hereby incorporated by reference in their entirety.

BACKGROUND

Overvoltage protection devices having thermal disconnection apparatus have been known for years in the prior art. The function of a disconnection apparatus is, in the event of unacceptably high heating of the overvoltage protection unit, e.g. a varistor, to safely disconnect it from the electrical network before the arrestor suffers any damage.

Disconnection apparatus comprising solid sliders are known from EP 0 987 803 B1 and EP 0 905 839 B1. The respective slider is spring-loaded and each protect a varistor from unacceptable thermal heating. The closed position of the respective connection elements is fused by a solder. The solder is subjected to the constant spring preload force conveyed by the slider, which is a substantial disadvantage. Depending on the rating; i.e. the desired current-carrying capacity, a plurality of disconnection apparatus are required, which constitutes a disadvantage in terms of costs. It has furthermore been shown with the above prior art solutions that solder particles or particulate matter become entrained and form solder filaments during the disconnection process and the displacing motion of the slider, resulting in insufficient electrical disconnection.

The DE 295 19 313 U1 utility model indicates an overvoltage protection device having a thermal disconnection apparatus, wherein the disconnection apparatus is positioned separately from the actual varistor by means of a partition wall. The surge current carrying capacity of such a disconnection apparatus is too low from today's perspective and its solder joint subject to a constant spring preload force.

The known DE 2 220 264 A relates to a thermal protection or warning device in which actuation is blocked by a temperature-sensitive retaining element and the retaining element activates a slider as a result of melting upon a predetermined temperature being reached.

DE 1 515 019 A discloses a temperature limiter in which two leaf springs are soldered together by solder which melts upon a certain temperature being reached and are used particularly in fan heaters.

The generic DE 10 2007 042 991 B4 solves the task of specifying a further developed overvoltage protection device having a mechanical disconnection apparatus activated in the event of thermal overload, wherein the solder joint of the connection elements which releases upon disconnection is not to be constantly subjected to the effect of a mechanical force load. The known solution moreover exhibits a high surge current carrying capacity, wherein the surge current itself produces the contact pressure for the discharging process. The disconnection apparatus according to DE 10 2007 042 991 B4 is realized such that the feed to the voltage-limiting overvoltage protection units, particularly varistors, is formed by two conducting sections extending parallel in the end region and merging into a common solder joint fused by solder with surge current flowing through the sections in the same direction. Upon surge current, the respective sections of the leads, respectively brackets, attract the parallel current flow and the thereby associated effects of the force and at that time effect the desired increase in contact force on the solder joint. This makes it possible to dimension the solder joint solely to fix the sections of the brackets, which enables the mechanical dimensioning of the solder joint to be limited to an absolute minimum and thereby have it be particularly thermally sensitive. The spring of this respective disconnection apparatus, the function of which consists of displacing a solder between the current paths when the solder joint melts and thus interrupt the electric circuit, can be realized with lower spring force so as to result in lower constant loading of the solder joint. Since the slider drives directly into the solder joint upon disconnection, negative effects are prevented during the disconnection process and safe, voltage-free cut-off achieved.

Disadvantageous with respect to the DE 10 2007 042 991 B4 solution is the fact that the slider is functionally coupled with the visual signaling of the slider position and thereby a display of the functional properties of the disconnection apparatus. For this reason, the slider thus needs to be structurally designed so as to exhibit the most even, color-differentiated display area possible in order to make clear the respective functional state of the respective overvoltage protection device. Furthermore, the slider's direction of movement upon overload for disconnecting the varistors preferably utilized is predefined so that the position of a display window for identifying the state of movement of the slider is also structurally determined, which represents a disadvantage for example when the size of the respective overvoltage protection device is decreased.

SUMMARY

Embodiments of the present invention relate to an overvoltage protection device comprising at least one overvoltage protection unit having at least one contact lug as well as a mechanical disconnection apparatus activated in the event of thermal overload, wherein the mechanical disconnection apparatus comprises a connection element able to be moved from a closed position into a current interrupting or voltage cut off position by a slider preloaded by a spring force.

BRIEF DESCRIPTION OF THE DRAWINGS

The following will reference an embodiment as well as the figures in describing the invention in greater detail.

The figures thereby show.

Figure 1:
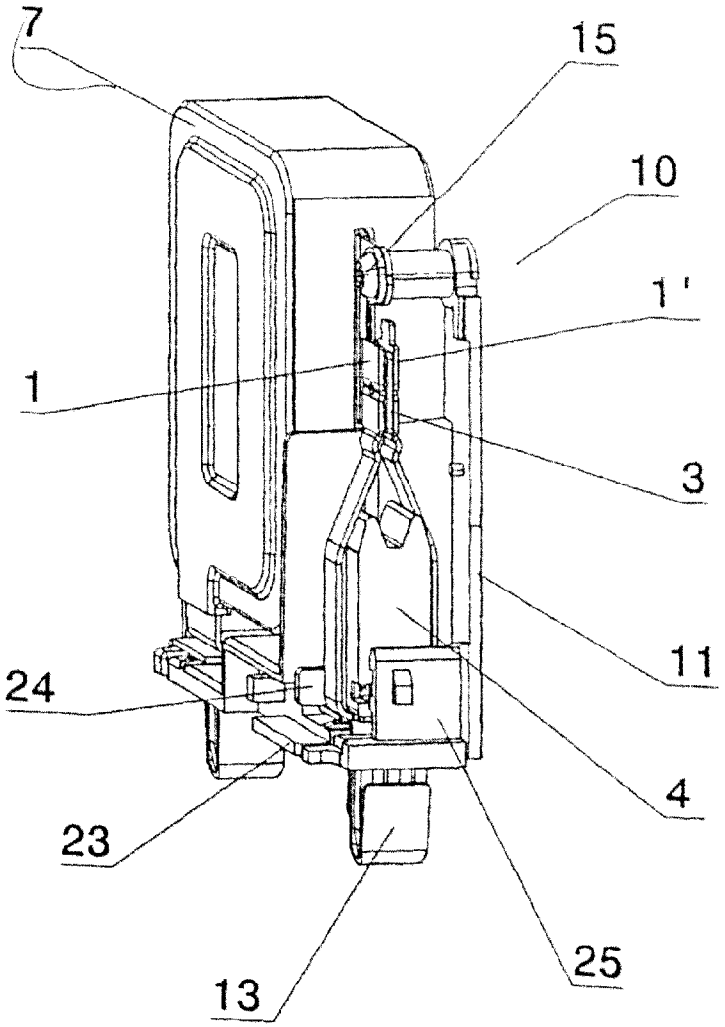
FIG. 1 a perspective side view of the apparatus according to the invention having a supporting body as well as a varistor as an overvoltage protection unit depicted without housing and without a visual indicator being mounted.

The following description of the figures will use the same reference numerals in each case, wherein details recognizably repeated in the figures will not be reiterated multiple times without thereby limiting the nature of the invention or involving a nuance of valence with respect to individual structural elements.

DETAILED DESCRIPTION

Based on the above, it is thus the task of the invention to specify a further developed overvoltage protection device comprising at least one overvoltage protection unit having a mechanical disconnection apparatus which is or can be activated in the event of a thermal overload, which on the one hand exhibits positive effects in terms of current flow and the thereby associated forces upon a surge voltage and moreover enables functional separation of a visual indicator for the slider and its movement as necessary for the functional state of the overvoltage protection units employed. Furthermore, the possibility is provided to integrate a signaling device for monitoring the overvoltage protection unit status into the overvoltage protection device designed in particular as a plug-in component so that only minimum installation space is required and there is no appreciable mechanical loading of the thermal joint fused with solder or a thermally soluble adhesive.

One therefore proceeds from an overvoltage protection device comprising at least one overvoltage protection unit, particularly a varistor, wherein the overvoltage protection unit has at least one contact lug. The overvoltage protection device moreover comprises a disconnection apparatus which is activated upon thermal overload, wherein the disconnection apparatus in turn comprises a connection element able to be moved from a closed into a current-interrupting or voltage cut-off position by a slider preloaded by spring force, wherein the connection element consists of a pair of current-dividing metallic brackets, the ends of which directed toward the contact lug of the overvoltage protection unit extend in parallel and which receive the respective contact lug of the overvoltage protection unit between them. The closed position between the connection element and contact lug in the area of the parallel-extending ends of the brackets is fused by a solder joint or a thermally soluble adhesive or other similar means.

The far ends of the brackets from the contact lug of the overvoltage protection unit are connected together, enclosing a free space, and have a section in their further progression for external connector components, whereby the cited slider with preload spring is inserted into the free space so that the spring pretensioning is oriented in the direction of the contact lug of the overvoltage protection unit. The slider is preferentially of wedge shape and/or sections of the brackets form an inclined surface in order to generate a force component on the parallel ends of the brackets when the slider moves such that they move away from the contact lug laterally.

Reference is made to DE 10 2007 042 991 B4 with respect to the design details of the slider and bracket, the disclosure of which is declared as being subject matter of the present teaching.

In accordance with the invention, the ends of at least one of the brackets oriented toward the contact lug form a limit stop for a visual indicator which is pivotable about an axis, wherein the pivoting motion is then enabled when the ends of the parallel-extending brackets are moved away from the contact lug laterally with the help of the slider.

In this embodiment of the invention, the position of the above-cited axis can be perpendicular to the path of movement taken by the slider, whereby expanded design options result for the arrangement of the visual indicator and, ultimately, the path traveled by the slider is uncoupled and separate from the movement or pivoting path of the visual indicator.

In one embodiment of the invention, the pivotable visual indicator comprises a pawl projection as well as a signaling projection, wherein the signaling projection gives way to a display area with color coding. The display area can hereby have a curved surface in order to maintain approximately the same distance relative to a display window depending on the pivot position.

During unhindered operation of the respective overvoltage protection unit in the respective overvoltage protection device, the pawl projection butts against the limit stop of the at least one bracket; i.e. the bracket blocks the movement of the pawl along with the pivotable visual indicator.

In one preferential embodiment of the invention, the above-cited limit stop can be formed as an integral or integrally molded projection relative to the corresponding end of the bracket. Since the brackets used for the disconnection apparatus are preferentially a punched/bent sheet metal part, the desired design to the projection can be readily realized in the punching process without technical complexity.

The pivotable visual indicator is pretensioned by a spring element, particularly one designed as a spring rod, such that when the pawl projection releases, the spring element moves the pivotable visual indicator into a predetermined pivoted position such that the e.g. "red" signal code of the visual indicator is brought into the area of the cited display window, signaling the interruption/disconnection process.

The preload spring element for the pivotable visual indicator also holds the latter in the respective position after disconnection has been effected; i.e. the red color code also remains in the display window upon mechanical manipulations such as rotation, vibration, etc.

The invention furthermore provides a supporting body for the overvoltage protection device which can be realized as a plug-in component, said supporting body accommodating a remote signaling contact slider in a bottom section.

The displacement path of the remote signaling contact slider is blocked or enabled by a lateral projection of the disconnection slider depending on its position. The remote signaling contact slider is hereby spring loaded, whereby the spring force vector exhibits no component of force toward the parallel ends of the disconnection apparatus brackets for lateral motion away from the contact lug.

Structurally, the supporting body has lateral guide surfaces comprising latching projections or engagement recesses for fixing the housing with the display window. In conjunction hereto, the housing has complementary engagement recesses or latching projections on its corresponding side surfaces.

In the invention as configured, a cavity for receiving an end of the preload spring is positioned in the longitudinal direction of the movable slider for the disconnection apparatus such that the spring is securely held. The complementary end of the spring can be guided by a rivet concurrently serving to connect a section of the metallic bracket to an external connecting part. A spot welding is equally possible.

As mentioned above, the ends of the bracket extending in parallel can be positionally fixed by a solder or a thermal adhesive, although are designed to separate in the disconnection process supported by a mechanical pretensioning.

The overvoltage protection unit, particularly a varistor, incorporated into the overvoltage protection device can be connected to the supporting body by a screw connection in order to prevent external forces from acting on the electrically relevant contact points. This screw connection also reduces external forces on the electrical connecting points including the thermal disconnection point, e.g. occurring in transport or other forces such as vibrations or the like.

The cited functional separation of the visual indicator and the actual disconnection apparatus with slider further provides the advantage of the disconnection process not being hindered by any possible blockage of the visual indicator movement.

The structural separation of the disconnection apparatus, the remote signaling contact control and the visual indicator can moreover effect a completely individual dimensioning of the spring preload force required in each case.

In the perspective side view according to FIG. 1, a varistor 7 is recognizable as an inserted overvoltage protection unit. The varistor 7 is fixed to a projection of the supporting body 11 by a tab and a screw 15, wherein the projection can simultaneously form a rotational axis 10 for a visual indicator 17 (see FIG. 2 or 3).

The connection element forming the disconnection apparatus consists of a pair of parallel-extending, current-dividing metallic brackets 1, 1', their ends directed toward a contact lug 14 and receiving the respective contact lug 14 between them. A solder 3 or a thermally soluble adhesive or other such means secures the closed position between the connection elements and the contact lug 14 in the area of the parallel extending ends of the bracket 1.

Figure 5:
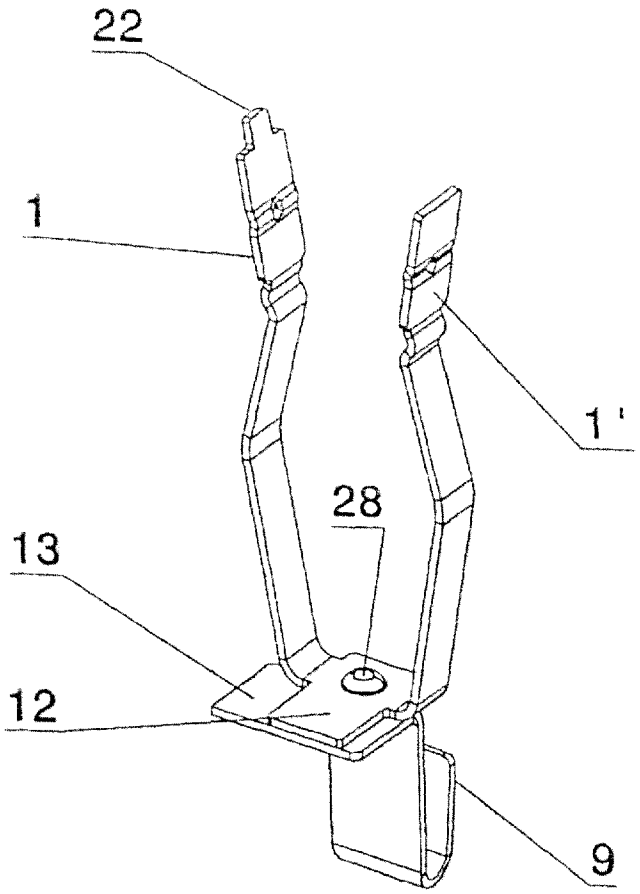
FIG. 5 a perspective depiction of a detail of the current-dividing metallic bracket together with an external connector and plug connection.

As is evident from FIG. 5, the ends of the bracket 1, 1' remote from the contact lug 14 of the overvoltage protection unit, enclosing a free space, are connected together and have a section 12 for external connectors 13 in their further progression. The slider 4 visible in FIG. 1 with preload spring 2 (see FIG. 3) is inserted into the free space recognizable in FIG. 5. Said spring preload is oriented in the direction of the contact lug 14 of the overvoltage protection unit 7.

The slider 4 has a wedge shape. Additionally or alternatively, corresponding sections of the brackets 1, 1' forming an inclined surface are realized in order to create a force component on the parallel extending ends of the brackets 1, 1' upon movement of the slider so that they will move away from the contact lug 14 laterally.

Reference numeral 9 in FIG. 5 identifies an integral curved plug connection which then forms connector 13 according to FIG. 1.

Figure 2:
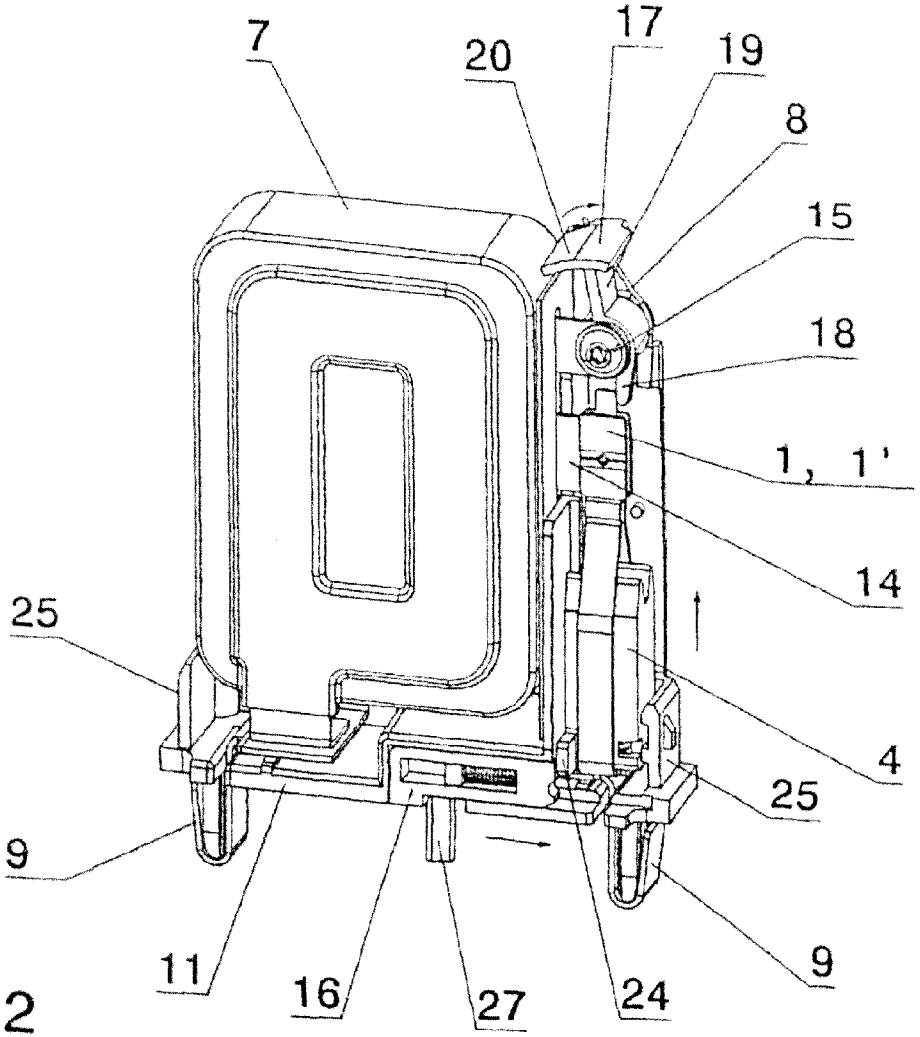
FIG. 2 a view similar to that of FIG. 1, although slightly turned, with a remote signaling device slider and functionally separate visual indicator already mounted.

The FIG. 2 depiction now shows further details of the inventive apparatus, particularly the visual indicator 17, functionally separate with respect to the slider 4, with bar spring 8, signaling projection 19 and pawl projection 18.

FIG. 2 further shows the slider 16 for the remote signaling contact together with a projection 24 of slider 4 which serves as the limit stop for the remote signaling contact slider 16.

Figure 4:
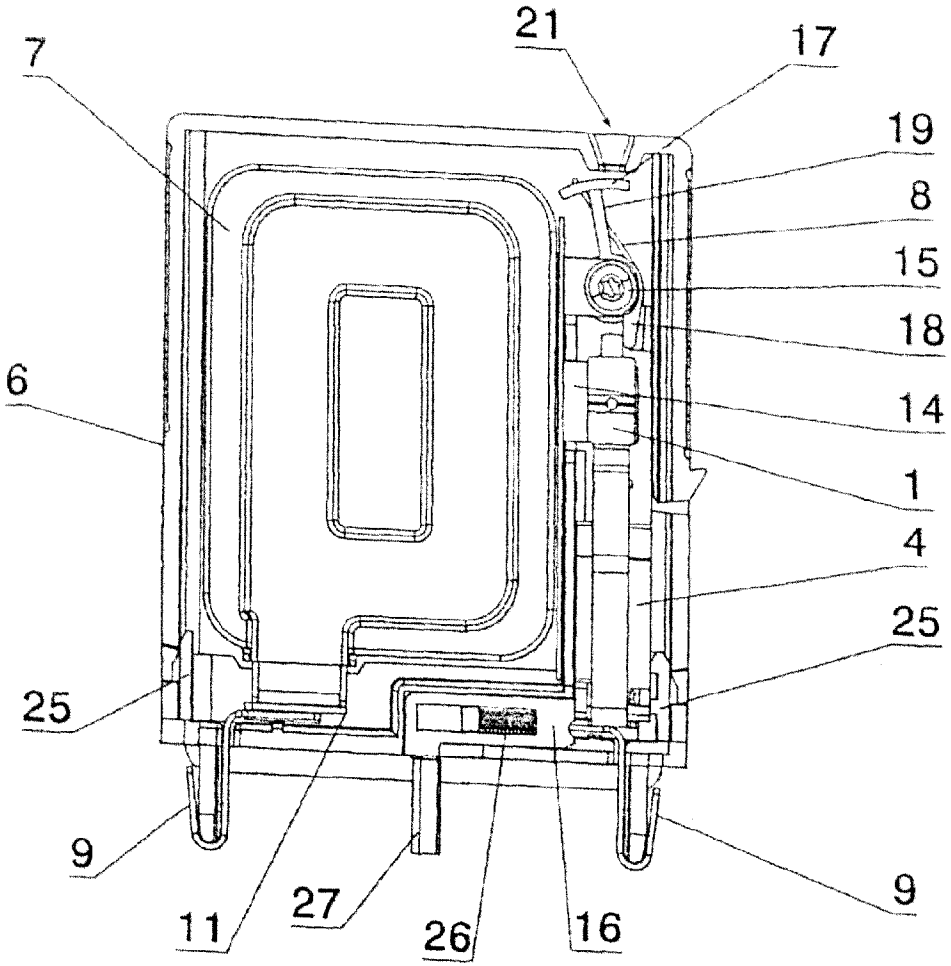
FIG. 4 a side view of a functional plug-in component in the initial position of the remote signaling contact slider as well as the disconnection slider during normal uninterrupted operation with the external housing partially broken away.

Guide surfaces 25, which are a lateral component of the supporting body 11, comprise a latching projection in the example shown which forms a connection with a complementary engagement recess of the housing 6 and thus fixes the housing 6 to the supporting body 11 (see FIG. 4). The displacement path of the slider 4 upon disconnection is symbolized by an arrow. An arrow is also used to indicate the displacement path of the pivotable visual indicator 17, whereby reference numeral 20 identifies a display area symbolizing the respective functional state (open/disconnected).

The depiction of FIG. 2 shows the normal operating condition, whereby the relevant visual indicator 17 is shown pivoted to the left.

Figure 3:
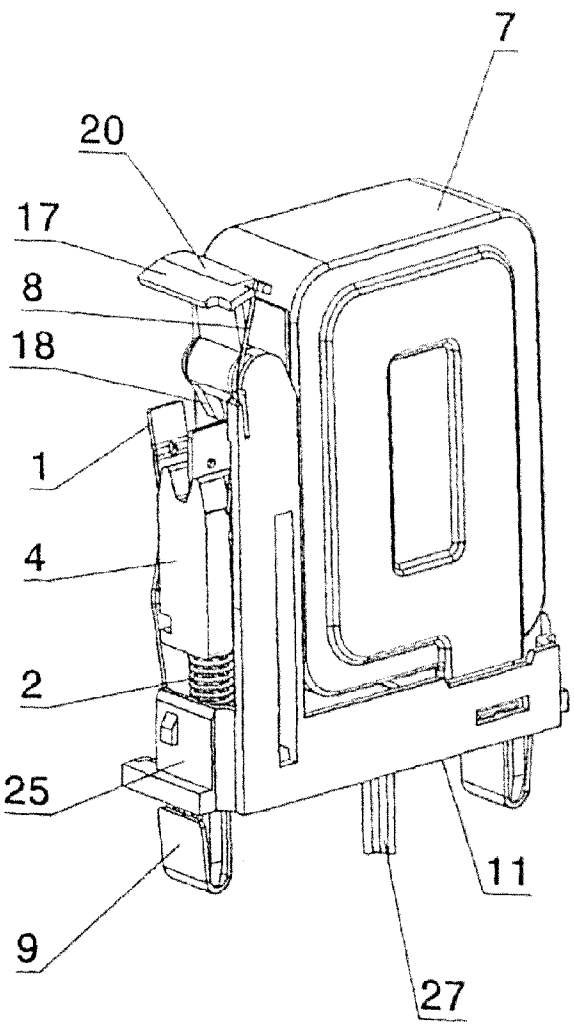
FIG. 3 two perspective views of the apparatus according to FIG. 2 with actuated disconnection apparatus and the visual indicator switched to the "RED" signal status including the changed position of the slider for the remote signaling contact (left image of FIG. 3)
Figure 3:
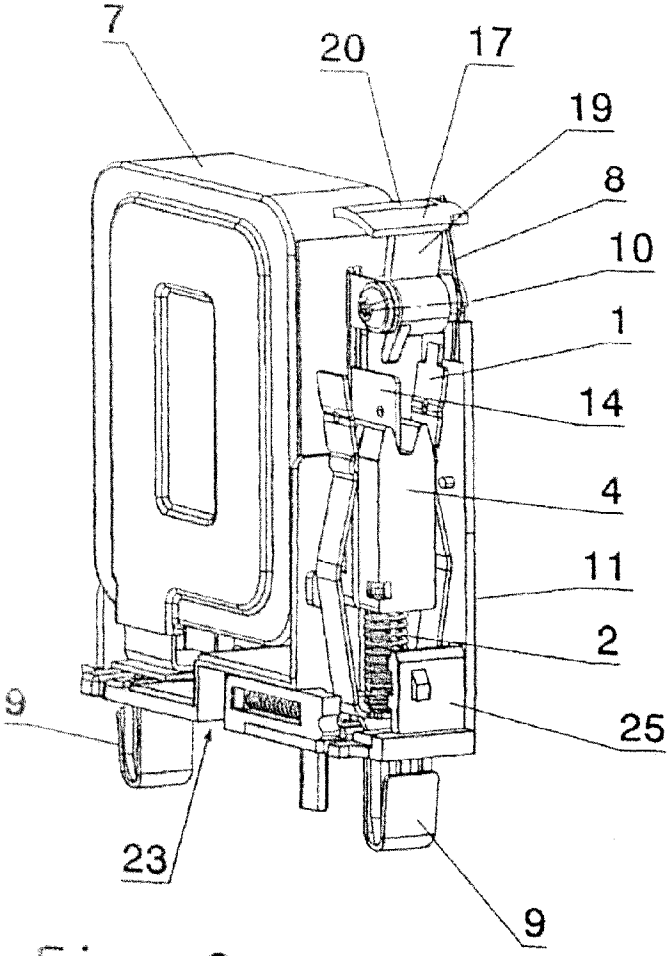

The "separation-malfunction" operating condition can be comprehended on the basis of the FIG. 3 depiction. It is evident here that the slider 4 aided the lateral movement of the bracket 1. The pivoting motion of the pivotable visual indicator 17 is hereby also enabled. The rod-shaped spring 8 then effects the corresponding pivoting motion to the right in the example shown in FIG. 3, left part of the image. The corresponding, e.g. red field of the visual indicator is then visible in the display window 21 (see FIG. 4).

Figure 8:
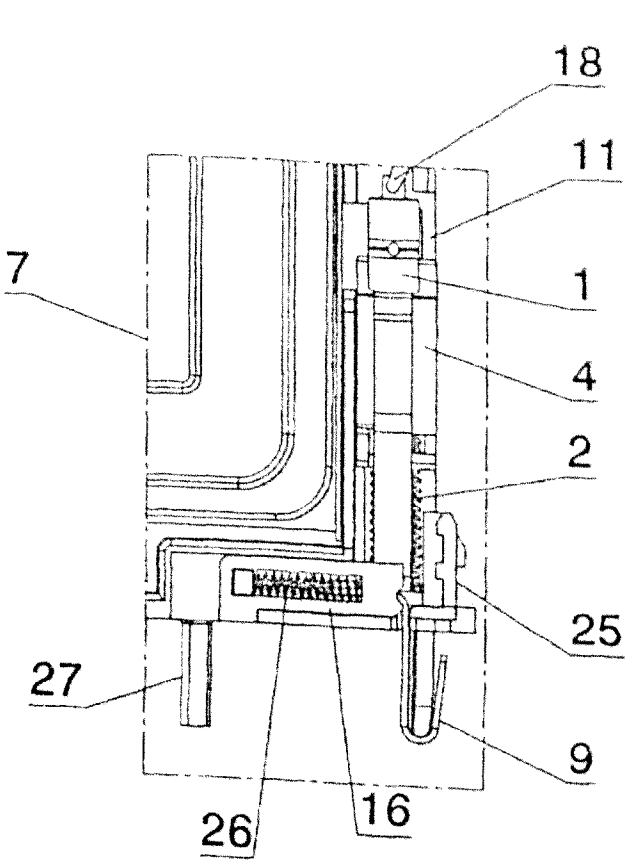
Figure 8:
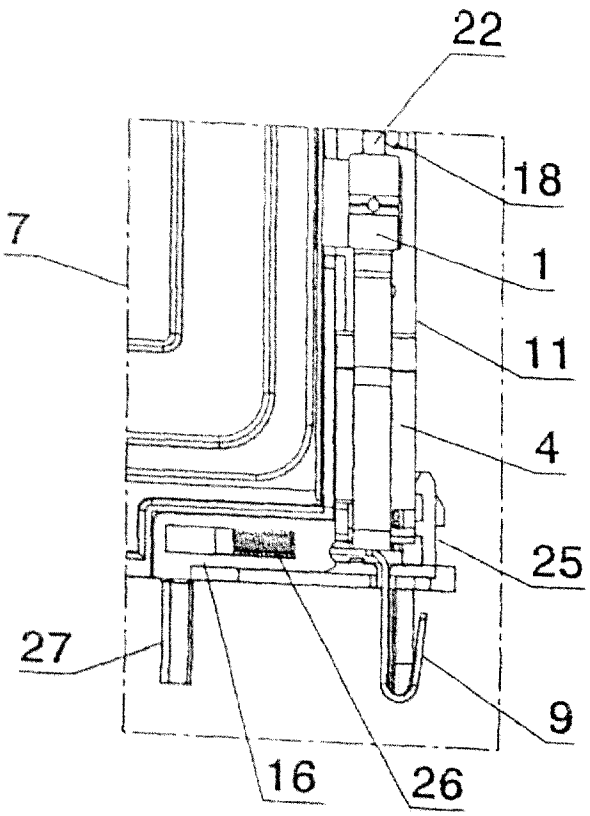

Similarly, the movement of the slider 4 upward in the figurative representation also moves the projection 24 of the slider 4 away from the remote signaling contact slider 16 so that the slider 16 can move to the right, left side of the FIG. 3 image, and do so by the action of a spring 26 utilized in the slider 16 (also see FIG. 8).

FIG. 4 shows a frontal view of the inventive apparatus with the housing 6 partly broken away, the display window 21 and the other functionally essential components, and shows them in the state of the functional overvoltage protection unit inserted into the apparatus; i.e. the varistor 7 situated there.

Figure 6:
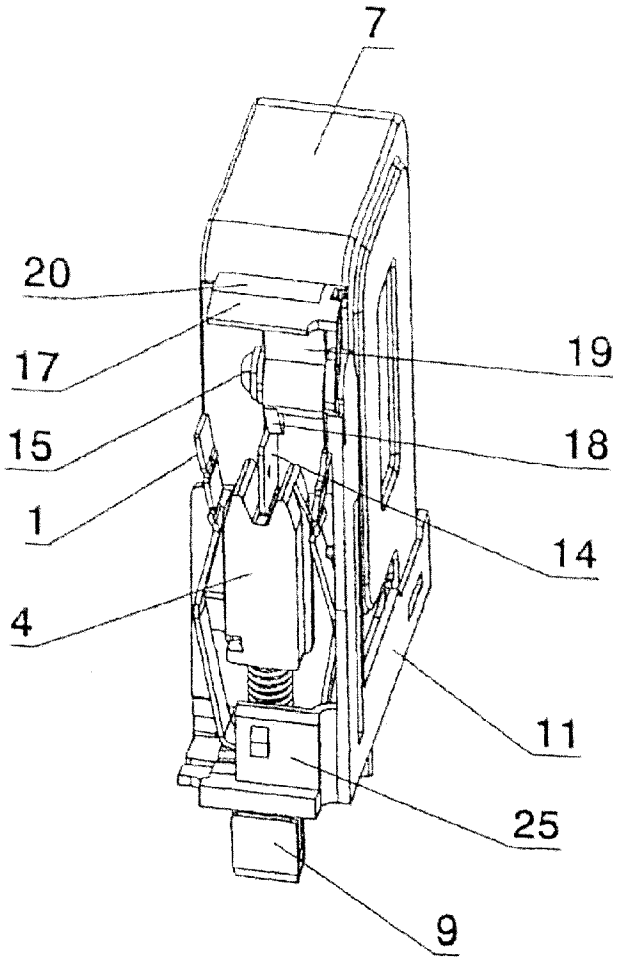
FIG. 6 a detail depiction of the inventive apparatus with the ends of the bracket moved laterally away from the contact lug upon thermal overload and released pivotable visual indicator in the "RED" status (malfunction)

As a detail depiction of the position of the slider 4 upon disconnection, FIG. 6 allows for recognizing that the upper part of slider 4 gives way to two cog-like ends. The two cog-like ends exhibit a section in the area of their sprocket base; i.e. in the clearance between the cogs, able to grasp the sides of the contact lug 14 and wall them off so to speak so that there is effective isolating upon disconnection and reliable prevention of arc ignition between the brackets 1, 1' and the contact lug 14.

The tooth height to the cog-like ends of the slider 4 is hereby also configured commensurate to the relevant height dimension of the contact lug 14.

Figure 7:
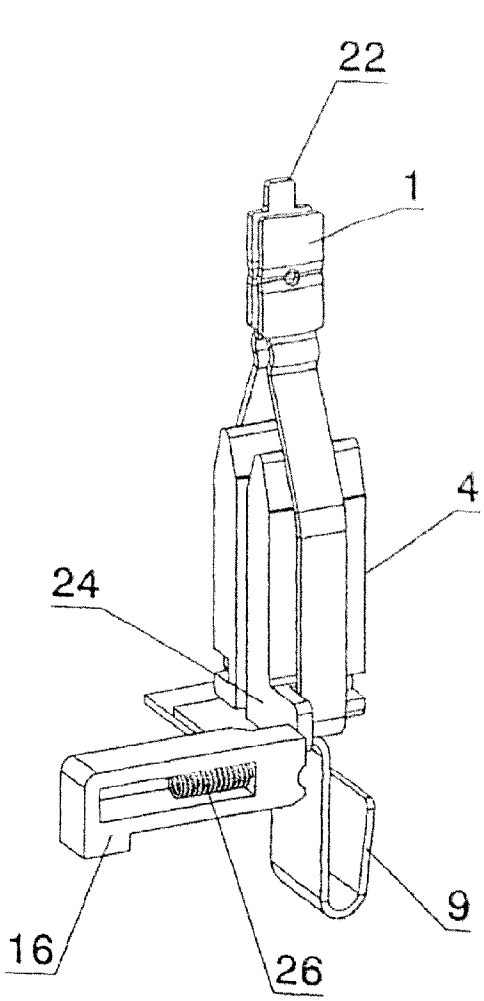
FIG. 7 two different perspective depictions of the detail of the remote signaling contact slider which is limited in normal operation by a lateral projection of the disconnection slider in terms of its displacement path, wherein it changes its position as per FIG. 4 upon disconnection upward movement of the disconnection slider of the corresponding limit stop releasing the remote signaling contact slider in order to effect movement to the right as per FIG. 7, and FIG. 8 a depiction of a detail of the inventive apparatus having a remote signaling contact slider and its different positions analogous to FIG. 7, here however with a figuratively supplemented bottom section of the supporting body as well as a varistor, plug connection and coding pin.
Figure 7:
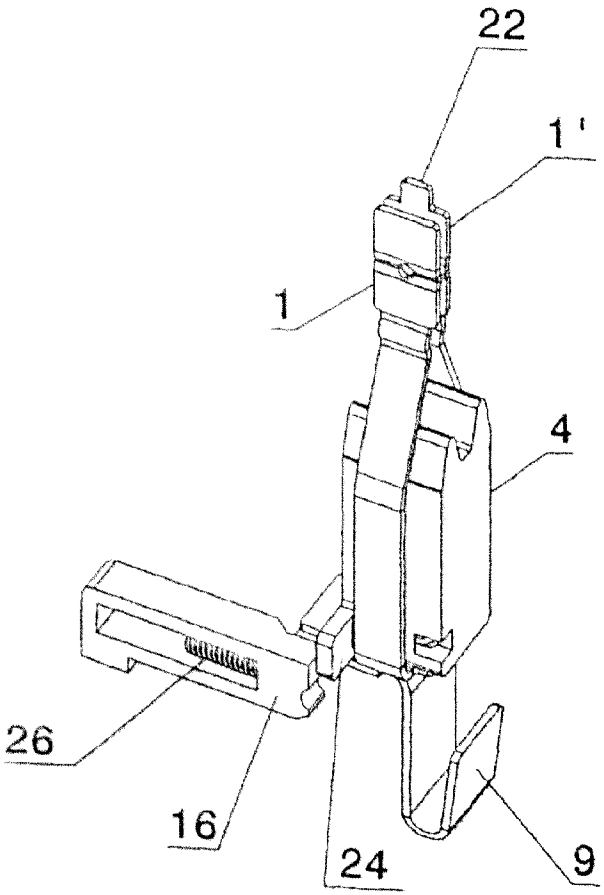

The FIG. 7 depictions clearly illustrate the effect of the projection 24 of the slider 4 in conjunction with a corresponding edge stop of the remote signaling contact slider 16. As long as the slider 4 remains in its initial position; i.e. a respective system exhibiting the relevant disconnection apparatus is operating uninterrupted, the slider 16 remains inaccessible to the remote signaling contact.

Should the slider 4 move upward in the figurative representation, the remote signaling contact slider 16 can move to the right in the left part of the FIG. 7 image, and do so by the action of a spring 26 utilized in the slider 16.

The above comments on FIG. 7 can also be analogously applied to the depictions provided in FIG. 8, whereby FIG. 8 additionally shows the supporting body 11 as well as the coding pin 27 and (partly cut away) varistor 7 utilized at the base of the supporting body 11.

In summary, the ends of at least one of the brackets 1, 1' facing the contact lug 14 form a limit stop for the visual indicator 17 able to pivot about axis 10. The pivoting motion is then enabled when the parallel extending ends of the brackets 1, 1' move laterally to the contact lug 14 by means of the slider 4.

The pivotable visual indicator 17 comprises the depicted pawl projection 18 as well as a signaling projection 19 which gives way to the display area 20 having the appropriate color coding.

The pawl projection 18 butts against the limit stop of the at least one bracket 1, 1' in normal operation. The limit stop can be configured as for example in FIGS. 5 and 7 as integral or integrally molded projection 22.

The pivotable visual indicator 17 is held at a pretensioning by a spring rod 8.

The supporting body 11 depicted in the figures comprises the remote signaling contact slider 16 in its bottom section 23, whereby the displacement path is blocked or enabled by the lateral projection 24 of the slider 4 depending on the position of the slider 4.

The remote signaling contact slider 16 is likewise pretensioned, whereby the spring 26 is inserted into the slider hereto and braced against a corresponding bottom section 23 area of the supporting body 11. However, the spring preload exerts no force toward the parallel ends of the brackets 1, 1' for lateral motion away from the contact lug 14. The disconnection point is thus not thereby subjected to unnecessary constant mechanical load or forces.

The cavity in slider 4 for receiving the preload spring 2 of the slider is recognizable in the left part of the FIG. 3 image, whereby the opposite end of the compression spring is guided by a stamped element or a rivet head 28 (see FIG. 5).

LIST OF REFERENCE NUMERALS

1 bracket
2 spring
3 solder joint
4 slider
5 pivotable display
6 housing
7 varistor
8 spring for visual indicator
9 external plug connection
10 axis of rotation
11 supporting body
12 section
13 connector
14 varistor contact lug
15 screw connection for varistor
16 slider for remote signaling contact
17 visual indicator
18 pawl projection
19 signaling projection
20 display area
21 display window in housing
22 projection/limit stop
23 bottom section of supporting body
24 slider projection
25 guide surface
26 spring of remote signaling contact slider
27 coding pin
25 rivet head or stamped element

What is claimed is:

1. An overvoltage protection device comprising:

at least one overvoltage protection unit having at least one contact lug as well as a mechanical disconnection apparatus activated in the event of thermal overload, wherein the disconnection apparatus comprises a connection element able to be moved from a closed position into a current-interrupting or voltage cut-off position by a slider preloaded by a spring force;

wherein the connection element consists of a pair of current-dividing metallic brackets, the ends of which directed toward the contact lug of the overvoltage protection unit extend in parallel and which receive the respective contact lug of the overvoltage protection unit between them;

wherein the closed position between the connection element and the contact lug in the area of the parallel-extending ends of the brackets is fused by a solder or a thermally soluble adhesive, with the far ends of the brackets from the contact lug of the overvoltage protection unit further being connected together, enclosing a free space, and having a section in their further progression for external connector components;

wherein the slider with a preload spring is inserted into the free space so that the spring pretensioning is oriented in the direction of the contact lug of the over-voltage protection unit, with the slider further being of a wedge shape or sections of the brackets forming an inclined surface in order to generate a force component on the parallel ends of the brackets when the slider moves such that they move away from the contact lug laterally; and wherein the ends of at least one of the brackets oriented toward the contact lug form a limit stop for a visual indicator pivotable about an axis, and wherein the pivoting motion is enabled when the ends of the parallel-extending brackets are moved away from the contact lug laterally by the slider.

2. The overvoltage protection device according to claim 1, wherein the pivotable visual indicator comprises a pawl projection as well as a signaling projection which gives way to a display area with color coding.

3. The overvoltage protection device according to claim 1, wherein a pawl projection butts against the limit stop of the at least one bracket during unhindered operation of the overvoltage protection unit.

4. The overvoltage protection device according claim 1, wherein the limit stop is formed as an integral projection.

5. The overvoltage protection device according to claim 1, wherein the pivotable visual indicator is held at a pretensioning by a spring rod.

6. The overvoltage protection device according to claim 1, wherein a supporting body is provided which accommodates a remote signaling contact slider in a bottom section, wherein its displacement path is blocked or enabled by a lateral projection of the slider depending on the position of said slider.

7. The overvoltage protection device according to claim 6, wherein the remote signaling contact slider is spring loaded, wherein the spring force vector exhibits no component of force toward the parallel ends of the brackets for lateral motion away from the contact lug.

8. The overvoltage protection device according to claim 6, wherein the supporting body has lateral guide surfaces comprising latching projections or engagement recesses for fixing a housing with a display window provided therein.

9. The overvoltage protection device according to claim 1, wherein a cavity for receiving an end of the spring is longitudinally positioned in the movable slider.

10. The overvoltage protection device according to claim 1, wherein the parallel-extending ends of the bracket are positionally fixed by the solder or adhesive, although separate in the disconnection process supported by a mechanical pretensioning.

* * * * *